United States Patent [19]

Gardner et al.

[11] 3,931,924

[45] Jan. 13, 1976

[54] ERECTABLE PARTITION

[75] Inventors: Jeffrey M. Gardner, Wheaton, Ill.; William M. Pilz, III, Eldridge, Iowa

[73] Assignee: Container Corporation of America, Chicago, Ill.

[22] Filed: Oct. 9, 1974

[21] Appl. No.: 513,459

[52] U.S. Cl. ..... 229/28 R; 229/15; 229/42

[51] Int. Cl.[2] ..... B65D 5/48

[58] Field of Search ..... 229/15, 42, 28 R, 29 D

[56] References Cited

UNITED STATES PATENTS

| | | | |
|---|---|---|---|
| 1,860,567 | 5/1932 | Boeye | 229/15 |
| 2,013,240 | 9/1935 | Harvey | 229/15 X |
| 2,860,825 | 11/1958 | Montgomery et al. | 229/42 |
| 3,317,111 | 5/1967 | Black | 229/15 |
| 3,738,561 | 6/1973 | Nederveld | 229/15 |
| 3,758,018 | 9/1973 | Black | 229/42 X |

*Primary Examiner*—William Price
*Assistant Examiner*—Stephen P. Garbe
*Attorney, Agent, or Firm*—Carpenter, Ostis & Lindberg

[57] ABSTRACT

An erectable partition is provided for dividing a walled container into equal size compartments, and consists of end, side and confronting panel elements connected along parallel score lines and folded to erected position wherein there is provided pairs of partition elements, each consisting of two parallel and spaced side panel elements, two coplanar confronting panel elements and an end panel element parallel to the coplanar elements, the confronting coplanar elements being foldably connected in spaced relationship by hinge means, there being a separating panel element foldably connected to one of the confronting panel elements and folded between the confronting pairs of panel elements.

3 Claims, 7 Drawing Figures

LEGEND

SCORE LINE

CUT LINE

CUT OUT AREA

ERECTABLE PARTITION

BACKGROUND OF THE INVENTION

THE PRIOR ART

The most pertinent prior art developed in the search appears to be the followings patents:

| | |
|---|---|
| Bergstein | 2,154,085 |
| Black | 3,317,111 |
| Foley | 3,260,440 |

Bergstein is wholly lacking in the teaching of a central panel element and is also lacking in the teaching of a construction whereby six equal size compartments are provided within a walled container upon erection of the partition. Black, while it teaches the dividing of a container into six equal compartments, is lacking in the teaching of a separating panel element which is foldably connected to one of the confronting panel elements, Black teaching the provision of a separating panel element folded up from a base panel rather than from one of a pair of confronting panel elements. Foley requires a great deal more paperboard in providing six cells than that required according to the teachings herein.

SUMMARY OF THE INVENTION

The invention herein relates generally to the dividing of a walled container into six equal-sized compartments by means of an erectable partition which is stable irrespective of whether it is disposed within the container or without the same, the partition being readily erectable by simple folding operations. The partititon structure according to the present invention is characterized by being formed from nestable blanks to minimize any waste in formation.

THE DRAWINGS

Figure 2:
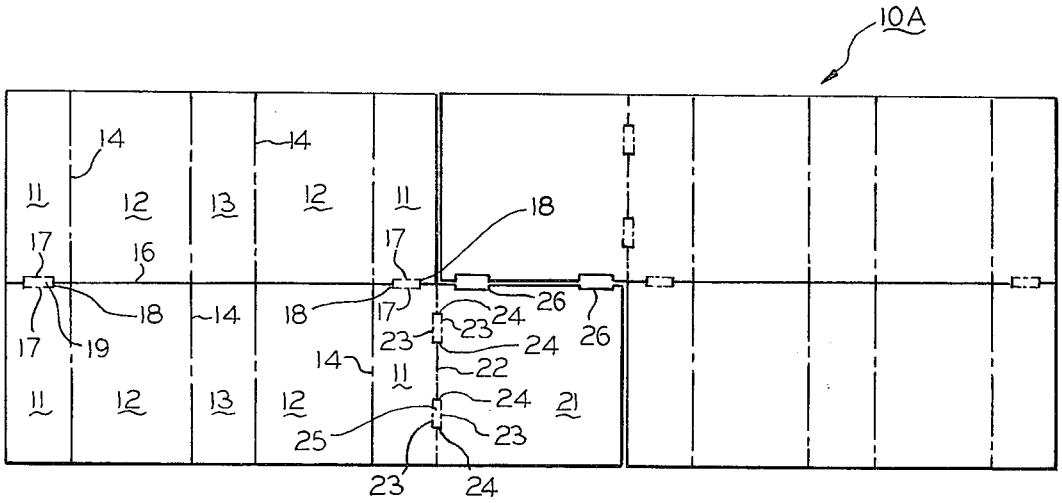
FIG. 2 is a plan view showing a pair of nestable blanks, one of the nested blanks being employed in the erection of the partition as seen in FIG. 1.
Figure 5:
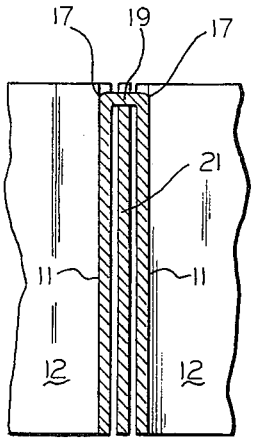
FIG. 5 is a sectional view looking in the direction of the arrows 5—5 of FIG. 1.

The partition according to the present invention is noted generally by the reference numeral 10 and is formed from a blank 10A seen in FIG. 2. Blank 10A is nestable as seen, and each blank consists of pairs of confronting panel elements 11, side panel elements 12 and end panel elements 13, these being foldably connected along parallel score lines 14. The foldably connected side, end and confronting elements are erected to a position with parallel side elements 12, two coplanar confronting panel elements 11, and end panel element 13 parallel to the coplanar confronting panel elements 11, spaced therefrom and connected thereto by the side panel elements 12.

Hinge means indicated generally by reference numeral 19 is defined by spaced score line 17, cut lines 18 perpendicular to a cut line 16 separating the pair of panel elements previously described.

A separating panel element 21 is foldably connected to one of the confronting panel elements 11, there being a cut line 22 separating panel 21 from panel element 11, excepting for hinge means 25 connecting separating panel element 21 to the confronting panel elements 11, hinge means 25 being defined by closely spaced score lines 23 and cut lines 24 perpendicular to cut line 22.

Figure 3:
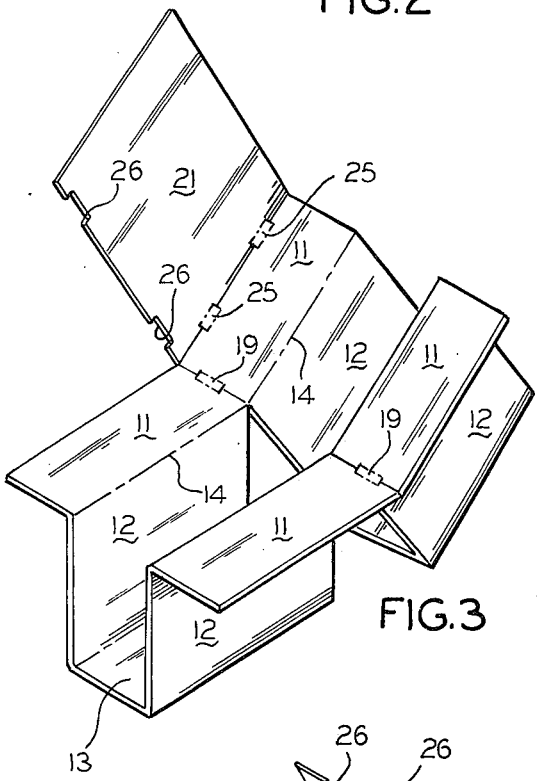
FIG. 3 is an isometric view showing one of the steps in erecting the partition seen in FIG. 1.

In the erection of the partition 10, the parts are folded as seen in FIG. 3, and panel 21 is folded between the confronting panel element 11, the hinge means 19 being of a dimension to permit readily the folding therebetween of the separating element 21. It will be noted that separating element 21 is folded into position along a vertical edge of panel element 11 when in the erected position thereof.

It may be noted that separating panel element 21 is provided with spaced notches 26 which fall into alignment with the hinge means 19, so that the hinge means 19 may properly extend between the notches 26.

Figure 7:
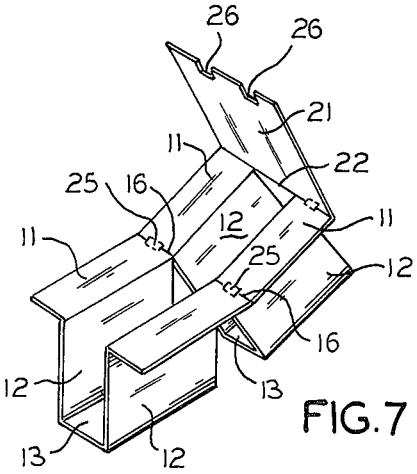
FIG. 7 is a view similar to FIG. 3 showing the erection of the divider constructed from the blank of FIG. 6.
Figure 6:
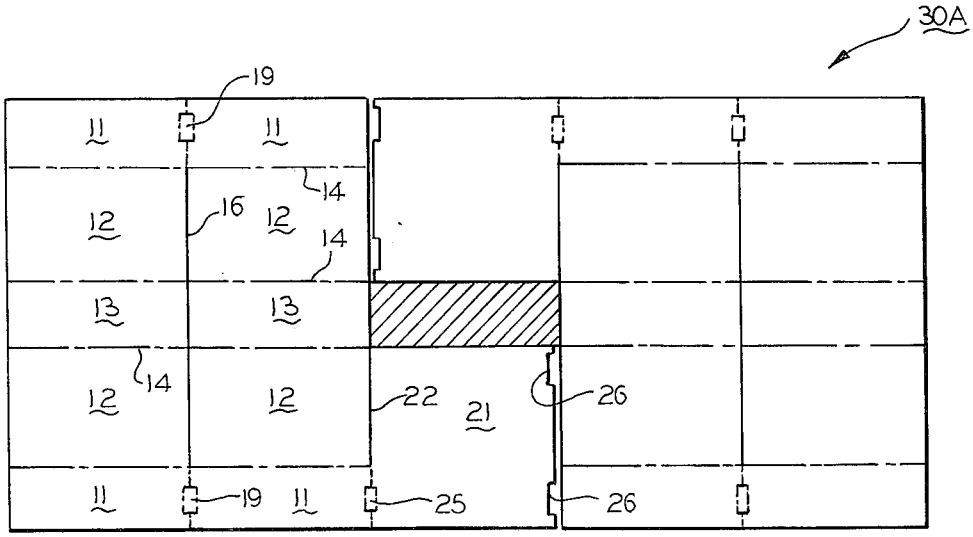
FIG. 6 is a plan view of a pair of nestable blanks for forming an alternate form of a partition according to the present invention.

Referring to FIGS. 6 and 7 there is shown another form of the invention, the difference between the two forms being the manner in which the separating panel element 21 is foldably connected to one of the confronting panel elements 11. It will be noted that separating panel 21 is folded along a horizontal edge of confronting panel element 11 when in the erected position thereof.

In this form of the invention the separating panel 21 is foldably connected to one of the confronting panel portions 11 along the shorter side thereof, it also being foldably connected thereto by hinge means 25. As with the embodiement seen in FIGS. 1 and 2, the separating panel 21 is provided with similar notches 26 which fall into register with the hinge means 19 connecting the confronting panel elements 11.

The step of erecting the blank seen in FIG. 6 is seen with respect to FIG. 7, and the separating panel element 21 is folded against one of the pairs of confronting panel elements 11 prior to being subsequently folded into position against the other pair of confronting panel elements 11.

Figure 1:
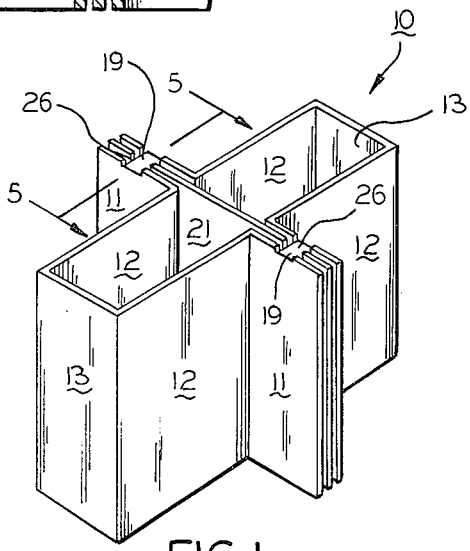
FIG. 1 is an isometric view showing an erectable partition according to the present invention.
Figure 4:
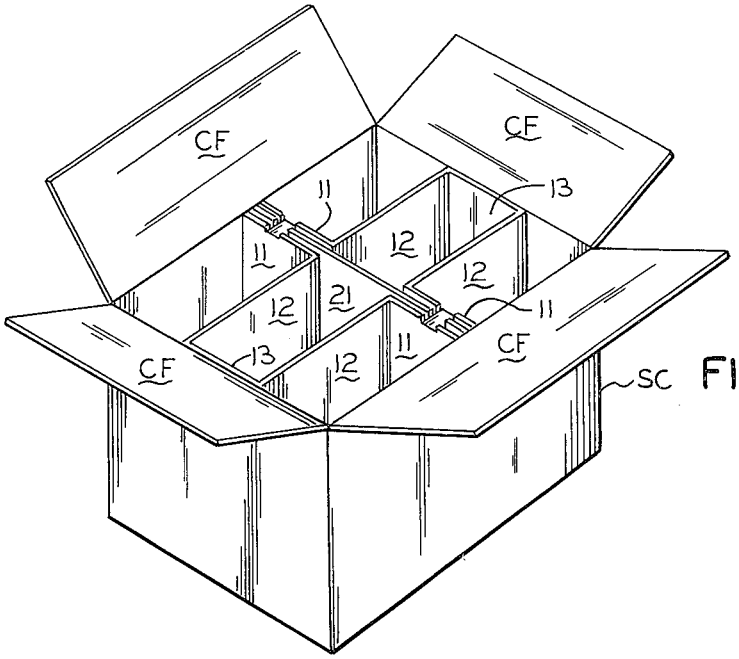
FIG. 4 is an isometric view showing the partition of FIG. 1 in position within a conventional shipping container.

Irrespective of whether the hinge means 19 is arranged as seen in FIG. 1, or whether it is arranged so as to be at the bottom of the panel elements 11, the erected partition structure is stable irrespective of whether it is being disposed in a shipping carton SC as seen in FIG. 4.

I claim:

1. A partition for dividing a walled container into compartments, said partition being characterized by being stable both within and without the container and being formed from cut and scored paperboard or the like, said partition comprising;

a. pairs of end, side and confronting panel elements foldably connected along parallel score lines;

b. said foldably connected end, side and confronting elements defining two sets of parallel and spaced side panel elements, two sets of coplanar confronting panel elements and two end panel elements, each of said panel elements being parallel to said coplanar confronting panel elements and spaced therefrom and also connected to two of said confronting panel elements by two of said side panel elements;

c. hinge means connecting each set of confronting panel elements;

d. a separating panel element foldably connected to one of said confronting panel elements and positioned between each set of confronting panel elements.

2. The partition according to claim 1 wherein said separating panel element is foldably connected to one of said confronting panel elements along a vertical edge thereof.

3. The partition according to claim 1 wherein said separating panel element is foldably connected to one of said confronting panel elements along a horizontal edge thereof.

* * * * *

UNITED STATES PATENT AND TRADEMARK OFFICE

CERTIFICATE OF CORRECTION

PATENT NO. : 3,931,924

DATED : January 13, 1976

INVENTOR(S) : Jeffrey M. Gardner et al.

It is certified that error appears in the above-identified patent and that said Letters Patent are hereby corrected as shown below:

Claim 1, Paragraph (b), line 5, before "panel" insert -- end --.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*